US010448169B2

(12) United States Patent
Numata et al.

(10) Patent No.: US 10,448,169 B2
(45) Date of Patent: Oct. 15, 2019

(54) SOUND PRODUCING DEVICE

(71) Applicant: ALPS ALPINE CO., LTD., Tokyo (JP)

(72) Inventors: Taishi Numata, Niigata (JP); Yutaka Sato, Niigata (JP); Kiyoshi Sato, Niigata (JP); Hideji Sato, Miyagi (JP)

(73) Assignee: ALPS ALPINE CO., LTD., Tokyo (JP)

( * ) Notice: Subject to any disclaimer, the term of this patent is extended or adjusted under 35 U.S.C. 154(b) by 0 days.

(21) Appl. No.: 15/915,456

(22) Filed: Mar. 8, 2018

(65) Prior Publication Data

US 2018/0199139 A1 Jul. 12, 2018

Related U.S. Application Data

(63) Continuation of application No. PCT/JP2016/068486, filed on Jun. 22, 2016.

(30) Foreign Application Priority Data

Sep. 16, 2015 (JP) ..... 2015-183066

(51) Int. Cl.
*H04R 11/02* (2006.01)
*H04R 7/04* (2006.01)
(Continued)

(52) U.S. Cl.
CPC ..... *H04R 11/02* (2013.01); *H04R 7/04* (2013.01); *H04R 7/18* (2013.01); *H04R 7/10* (2013.01);
(Continued)

(58) Field of Classification Search
None
See application file for complete search history.

(56) References Cited

U.S. PATENT DOCUMENTS

2002/0142795 A1 10/2002 Imahori et al.
2011/0311090 A1* 12/2011 Nagumo ..... H04R 11/02 381/398
(Continued)

FOREIGN PATENT DOCUMENTS

JP S58-104597 6/1983
JP 2012-004850 1/2012
KR 20140013894 2/2014

OTHER PUBLICATIONS

International Search Report dated Sep. 6, 2016 in PCT/JP2016/068486 filed on Jun. 22, 2016.
(Continued)

*Primary Examiner* — Curtis A Kuntz
*Assistant Examiner* — Julie X Dang
(74) *Attorney, Agent, or Firm* — IPUSA, PLLC

(57) ABSTRACT

A sound producing device includes a diaphragm, an armature extending parallel to the diaphragm, a coil having a wire wound around the armature in multiple turns, multiple magnets facing the armature, a yoke supporting the multiple magnets, a transmitting body configured to transmit a vibration of the armature to the diaphragm, a driving-side frame on which the armature, the coil, and the yoke supporting the multiple magnets are mounted, and a vibration-side frame including an opening in which the diaphragm is vibratably supported. The driving-side frame and the vibration-side frame are placed one over the other.

9 Claims, 9 Drawing Sheets

(51) Int. Cl.
*H04R 7/18* (2006.01)
*H04R 7/10* (2006.01)
*H04R 31/00* (2006.01)

(52) U.S. Cl.
CPC ..... *H04R 31/006* (2013.01); *H04R 2400/11* (2013.01)

(56) References Cited

U.S. PATENT DOCUMENTS

2015/0010199 A1* 1/2015 Kim ..... H04R 11/02
381/417
2016/0050498 A1* 2/2016 Ogata ..... H04R 17/00
381/190
2016/0094917 A1* 3/2016 Wilk ..... H04R 3/007
381/398

OTHER PUBLICATIONS

Extended European Search Report for 16846061.6 dated Jun. 14, 2018.

* cited by examiner

SOUND PRODUCING DEVICE

CROSS-REFERENCE TO RELATED APPLICATIONS

This application is a continuation application filed under 35 U.S.C. 111(a) claiming benefit under 35 U.S.C. 120 and 365(c) of PCT International Application No. PCT/JP2016/068486, filed on Jun. 22, 2016 and designating the U.S., which claims priority to Japanese Patent Application No. 2015-183066, filed on Sep. 16, 2015. The entire contents of the foregoing applications are incorporated herein by reference.

BACK GROUND OF THE INVENTION

1. Field of the Invention

The present invention relates to sound producing devices in which an armature extending parallel to a diaphragm is provided and vibrations of the armature are transmitted to the diaphragm.

2. Description of the Related Art

Japanese Laid-open Patent Publication No. 2012-4850 ("Patent Document") describes an invention related to a sound producing device (an acoustic transducer).

According to this sound producing device, a case body and a cover body covering the opening of the case body are provided, and a holding frame is held between the case body and the cover body. The opening of the holding frame is closed with a resin film, and a diaphragm formed of a thin metal plate is adhered to the resin film.

An armature famed of a magnetic material is accommodated in the case body. The armature has a vibrating section and fixed sections formed together as one piece, and the fixed sections are positioned and fixed on the holding frame. A coil attachment section is formed in the armature, and a coil is fixed to this coil attachment section. The vibrating section is placed in a space in the winding center of the coil.

Furthermore, a yoke bent into a U-shape is provided, and a pair of magnets are held in the yoke. Wall sections of the yoke are fixed to the holding frame, and the vibrating section of the armature is positioned between the pair of magnets. The free end section of the vibrating section and the diaphragm are connected by a beam section.

According to the sound producing device of the above-described structure, the armature is magnetized by a voice current supplied to the coil, and the vibrating section vibrates because of the magnetization and the magnetic fields of the magnets. These vibrations are transmitted to the diaphragm through the beam section, so that the diaphragm vibrates to produce a sound.

SUMMARY OF THE INVENTION

According to an aspect of the present invention, a sound producing device includes a diaphragm, an armature extending parallel to the diaphragm, a coil having a wire wound around the armature in multiple turns, multiple magnets facing the armature, a yoke supporting the multiple magnets, a transmitting body configured to transmit a vibration of the armature to the diaphragm, a driving-side frame on which the armature, the coil, and the yoke supporting the multiple magnets are mounted, and a vibration-side frame including an opening in which the diaphragm is vibratably supported. The driving-side frame and the vibration-side frame are placed one over the other.

DETAILED DESCRIPTION OF THE PREFERRED EMBODIMENTS

Figure 1:
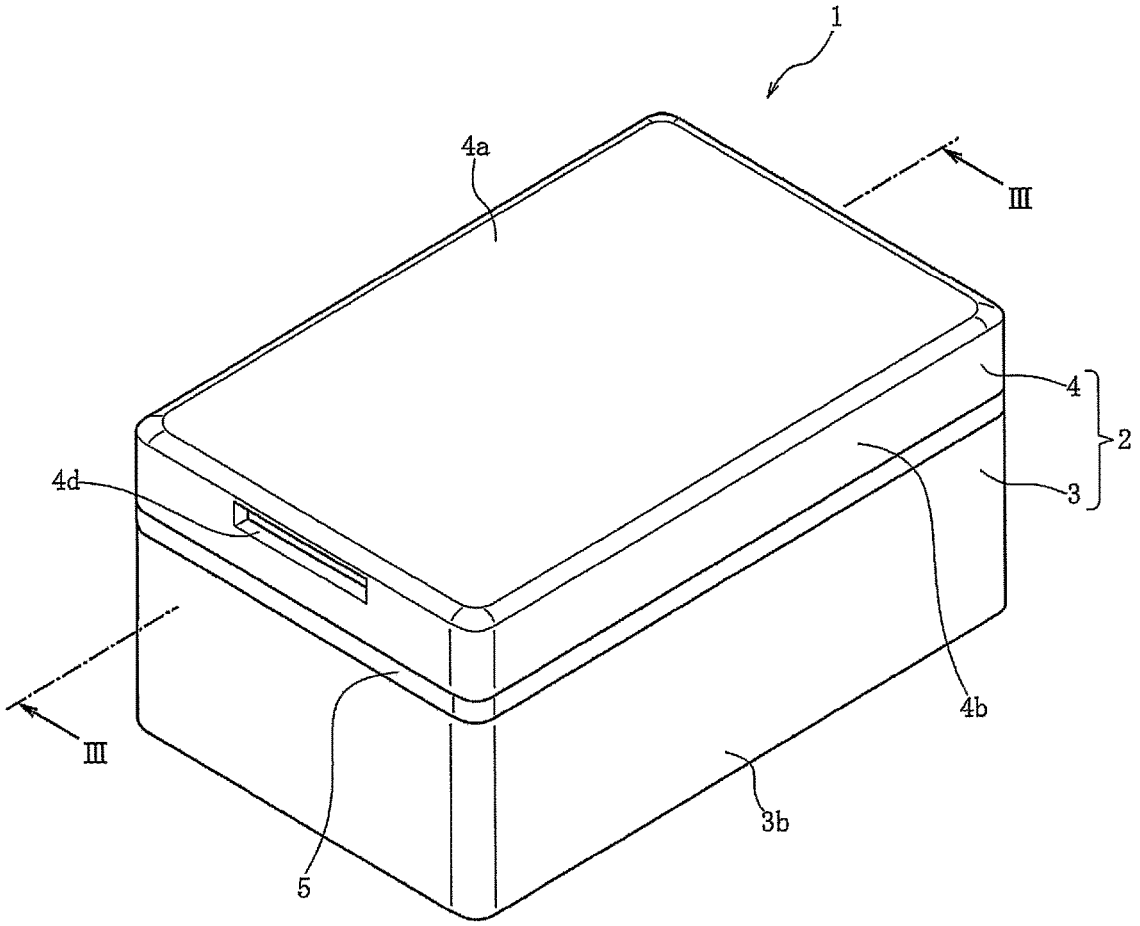
FIG. 1 is a perspective view illustrating the appearance of a sound producing device of a first embodiment of the present invention.

According to the conventional sound producing device described in Patent Document, the diaphragm is held on the single holding frame held between the case body and the cover body, and the armature including the vibrating section and supporting the coil and the yoke supporting the magnets are fixed to the same holding frame.

The holding frame, however, is for supporting the diaphragm within its opening, and therefore, it is necessary to ensure a large area for the opening, and the holding frame described in Patent Document 1 literally has a frame shape. Furthermore, the fixed sections of the armature and the wall sections of the yoke are positioned and fixed on the holding frame. Only a peripheral frame portion of the holding frame, however, is available for fixing the fixed sections and the yoke, and therefore, the positioning and the fixation of the armature and the yoke are unstable.

Furthermore, a large opening is formed in the center of the holding frame. Therefore, the magnets are prevented from being directly positioned and fixed on the holding frame, and have to be fixed to the inside of the U-shaped yoke. Likewise, the coil is prevented from being directly fixed to the holding frame, and has to be fixed to the armature.

Therefore, the dimensional tolerances and the mounting tolerances of components cumulatively relate to the mutual relative positional relationship of the vibrating section of the armature, the magnets, and the coil, thus making it difficult to determine their positions relative to one another with high accuracy by assembling alone. Therefore, in attaching the armature and the yoke to the holding frame, it is necessary to make adjustments in multiple stages to cause the relative positions of the vibrating section, the magnets, and the coil to fall within a predetermined tolerance, thus making assembly and adjustment work troublesome.

Secondly, the holding frame needs to be formed of a material with which an adhesive agent for adhering the resin film to which the diaphragm is joined has affinity. On the other hand, the holding frame needs to be formed of a material that does not block the magnetic path of a magnetic field induced to the armature by a coil current. It is difficult, however, to form the holding frame of a material that satisfies both of the above-described functions. Therefore, one of the above-described functions has to be degraded.

Embodiments of the present invention are described below with reference to the accompanying drawings. In the drawings, an XYZ coordinate system, which is a Cartesian coordinate system, is defined as illustrated, and in the following description, directions along the X-axis may be collectively referred to the X direction, directions along the Y-axis may be collectively referred to the Y direction, and directions along the Z-axis may be collectively referred to as the Z direction.

Figure 2:
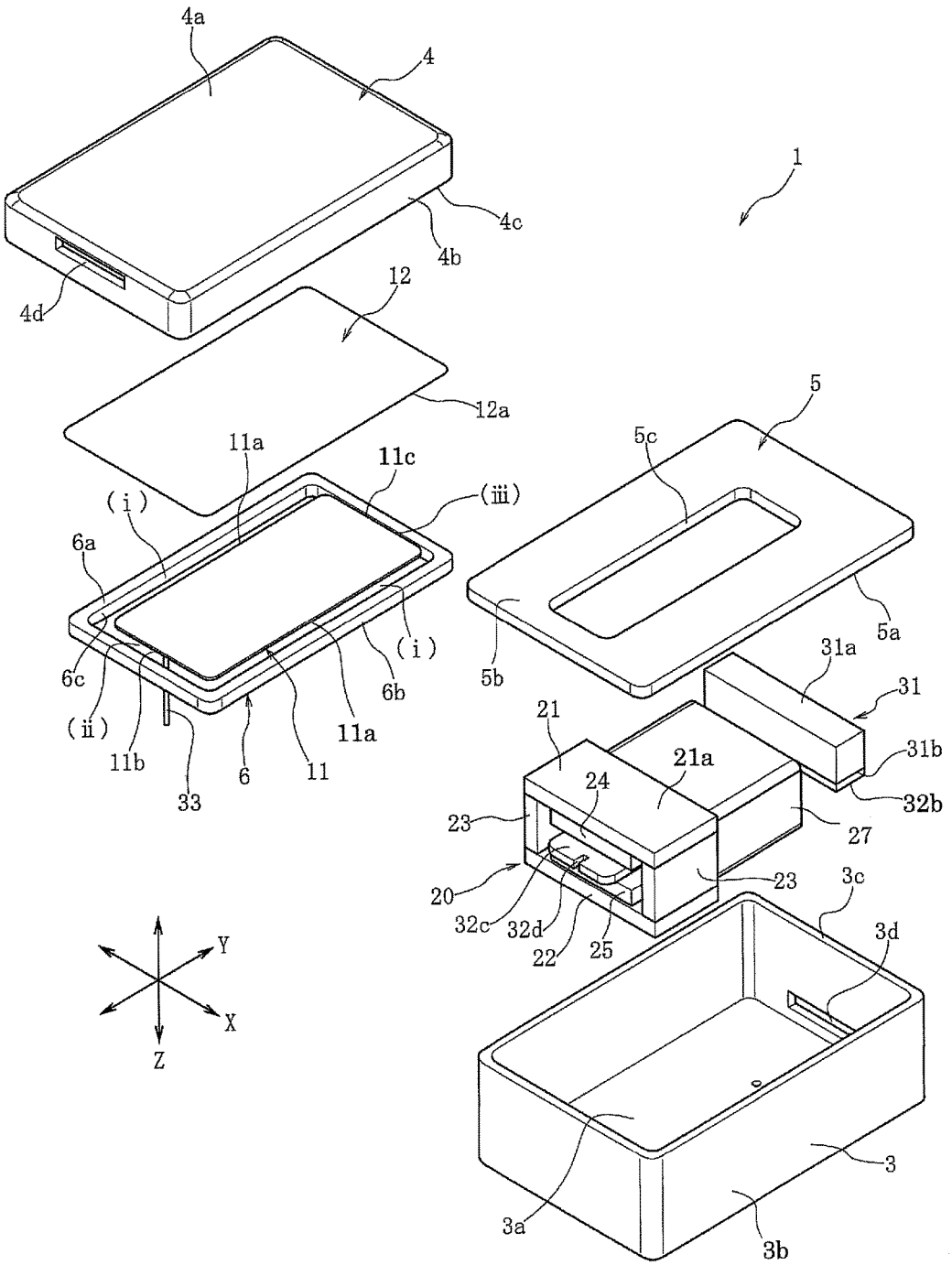
FIG. 2 is an exploded perspective view of the sound producing device illustrated in FIG. 1.
Figure 3:
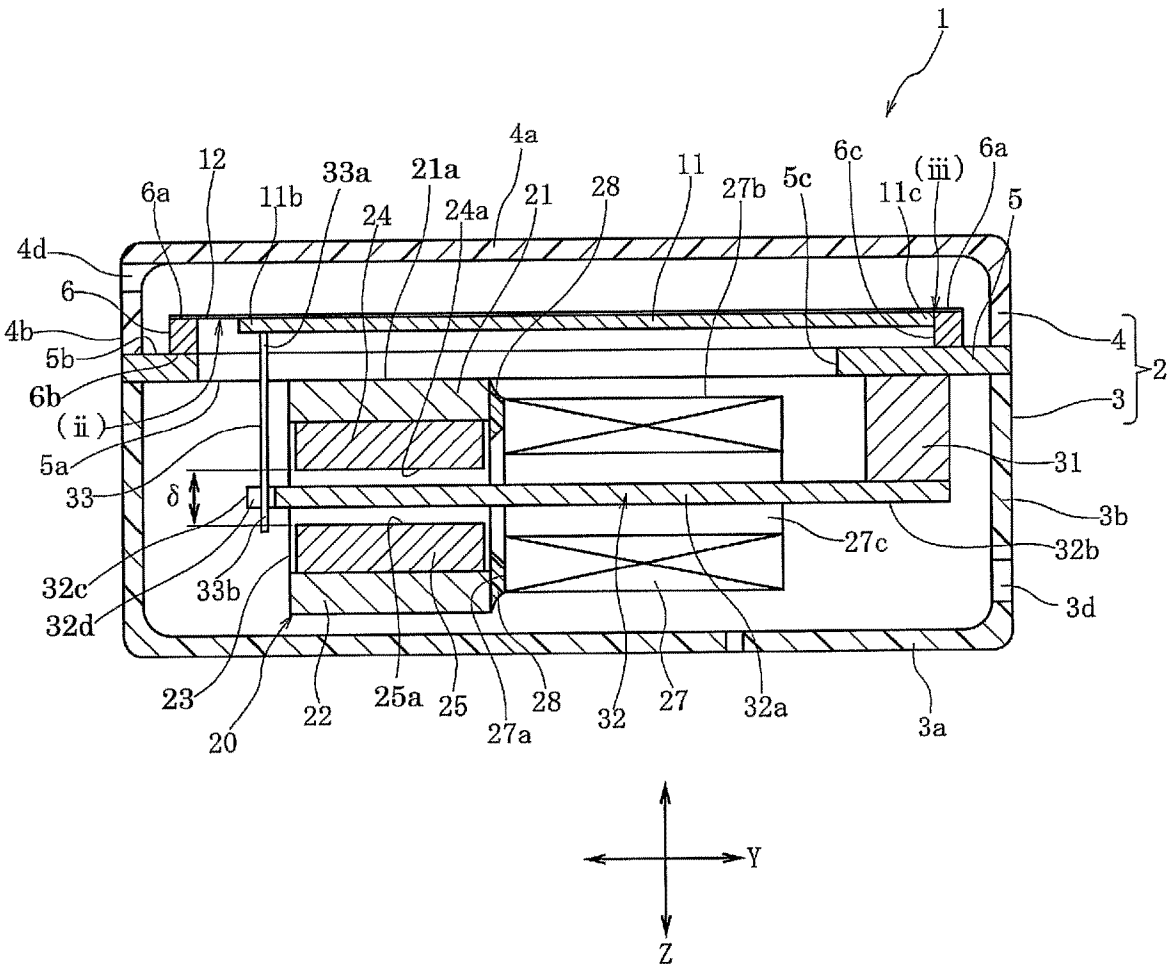
FIG. 3 is a sectional view of the sound producing device illustrated in FIG. 1, taken along the line III-III.

FIGS. 1 through 3 illustrate a sound producing device 1 of a first embodiment of the present invention. The sound producing device 1 includes a case 2. The case 2 is composed of a lower case 3 and an upper case 4. The lower case 3 and the upper case 4 are formed of a synthetic resin, or formed by die casting, using a nonmagnetic metal material.

As illustrated in FIG. 2, the lower case 3 includes a bottom 3*a*, a sidewall 3*b* extending along four sides, and an opening edge 3*c* at the upper end of the sidewall 3*b*. The upper case 4 includes a ceiling 4*a*, a sidewall 4*b* extending along four sides, and an opening edge 4*c* at the lower end of the sidewall 4*b*. The internal space of the lower case 3 is larger than the internal space of the upper case 4. The upper case 4 serves as a lid for the lower case 3.

A driving-side frame 5 is held between the opening edge 3*c* of the lower case 3 and the opening edge 4*c* of the upper case 4. Although not depicted, a positioning mechanism of male-female fitting is formed between the opening edge 3*c* of the lower case 3 and the driving-side frame 5, and a positioning mechanism of male-female fitting is formed between the opening edge 4*c* of the upper case 4 and the driving-side frame 5. The lower case 3, the upper case 4, and the driving-side frame 5 are positioned by these positioning mechanisms, and the lower case 3 and the upper case 4 and the driving-side frame 5 are fixed to each other by an adhesive agent or the like.

As illustrated in FIG. 2, the driving-side frame 5 is formed of a plate material having a uniform thickness dimension in the Z direction, and the illustrated lower plane surface is a driving-side attachment surface 5*a* and the illustrated upper plane surface is a joining surface 5*b*. A driving-side opening 5*c* is formed vertically through the center.

A vibration-side frame 6 is placed on the illustrated upper side of the driving-side frame 5. The vibration-side frame 6 has a frame shape with a vibration-side opening 6*c* of a large open area formed in the center. The frame section of the vibration-side frame 6 has a uniform thickness dimension in the Z direction, and the illustrated upper plane surface of the frame section is a vibration-side attachment surface 6*a* and the illustrated lower plane surface of the frame section is a joining surface 6*b*.

As illustrated in FIG. 3, the vibration-side frame 6 is placed over the driving-side frame 5, and the joining surface 5*b* of the driving-side frame 5 and the joining surface 6*b* of the vibration-side frame 6 are joined surface to surface. Although not depicted, a positioning mechanism of male-female fitting is formed between the driving-side frame 5 and the vibration-side frame 6, and the driving-side frame 5 and the vibration-side frame 6 are fixed by laser welding or with an adhesive agent, being positioned relative to each other.

As illustrated in FIGS. 2 and 3, a diaphragm 11 and a flexible sheet 12 are attached to the vibration-side frame 6. The diaphragm 11 is formed of a thin metal material of aluminum, SUC304 or the like, and on an as-needed basis, includes ribs formed by stamping to increase flexural strength. The flexible sheet 12 is more susceptible to flexural deformation than the diaphragm 11, and is formed of a resin sheet (a resin film) of, for example, PET (polyethylene terephthalate), nylon, or polyester.

The diaphragm 11 is bonded and fixed to the lower surface of the flexible sheet 12, and an outer peripheral edge section 12*a* (see FIG. 2) of the flexible sheet 12 is fixed through an adhesive agent to the vibration-side attachment surface 6*a*, which is the upper surface of the frame section of the vibration-side frame 6. As a result, the diaphragm 11 is vibratably supported on the vibration-side frame 6 through the flexible sheet 12.

As illustrated in FIGS. 2 and 3, the area of the diaphragm 11 is smaller than the open area of the vibration-side opening 6*c*, the flexible sheet 12 is greater in area than the diaphragm 11, and the flexible sheet 12 has substantially the same external dimensions as the vibration-side frame 6.

As illustrated in FIG. 2, gaps (i) are formed one between each of edges 11*a* of the diaphragm 11 in the X-direction (the width direction) and the vibration-side frame 6. A gap (ii) is formed between a free end 11*b* of the diaphragm 11 and the vibration-side frame 6. A gap (iii) narrower than the gaps (i) and (ii) is formed or a gap is scarcely formed between a support-side end 11*c* of the diaphragm 11 and the vibration-side frame 6. The gaps (i), (ii) and (iii) are closed by the flexible sheet 12. Because of the flexure and elasticity of the flexible sheet 12, the diaphragm 11 can vibrate on the support-side end 11*c* serving as a support in such a manner as to have the free end 11*b* displaced in the Z direction.

As illustrated in FIGS. 2 and 3, a magnetic field generating unit 20 is mounted on the driving-side frame 5. The magnetic field generating unit 20 is an assembly of an upper yoke 21, a lower yoke 22, and a pair of side yokes 23. The upper yoke 21 and the lower yoke 22 have the same flat-plate shape of the same size, and the side yokes 23 are held between the upper yoke 21 and the lower yoke 22. The upper yoke 21, the lower yoke 22, and the side yokes 23 are formed of a magnetic material, and are formed of, for example, a steel sheet such as a cold-reduced carbon steel sheet typified by SPCC; a Ni—Fe alloy; or the like.

As illustrated in FIGS. 2 and 3, according to the magnetic field generating unit 20, an upper magnet 24 is fixed to the lower surface of the upper yoke 21, and a lower magnet 25 is fixed to the upper surface of the lower yoke 22. As illustrated in FIG. 3, a gap δ is formed in the Z direction between a lower surface 24*a* of the upper magnet 24 and an upper surface 25*a* of the lower magnet 25. The magnets 24 and 25 are magnetized so that the lower surface 24*a* of the upper magnet 24 and the upper surface 25*a* of the lower magnet 25 have opposite polarities.

According to the magnetic field generating unit 20, the upper surface of the upper yoke 21 is a joining surface 21*a*, and the joining surface 21*a* is a plane surface. This joining surface 21*a* is joined to the driving-side attachment surface 5*a*, which the lower surface of the driving-side frame 5. This fixation is performed using a bonding process using an adhesive agent or a laser spot welding process. The driving-side opening 5*c* is formed in the driving-side frame 5. Compared with the vibration-side opening 6*c* for installing the diaphragm 11, formed in the vibration-side frame 6, the driving-side opening 5*c* can be reduced in open area. The area of the driving-side attachment surface 5*a* can be increased for this much, thus making it possible to position and fix the magnetic field generating unit 20 in a stable condition.

As illustrated in FIGS. 2 and 3, a coil 27 is installed side by side with the magnetic field generating unit 20. The coil 27 has a wire wound around a winding center line extending in the Y direction in multiple turns. As described below, a vibrating section 32*a* of an armature 32 is inserted into a space 27*c* in the winding center of the coil 27, and the coil 27 has a wire wound around the armature 32 in multiple turns.

In the embodiment illustrated in FIG. 3, an end face of the coil 27 facing leftward in the Y direction is a joining surface 27*a*, and this joining surface 27*a* is fixed to the upper yoke 21 and the lower yoke 22 of the magnetic field generating unit 20 by an adhesive agent layer 28. The joining surface 27*a* and the upper and lower yokes 21 and 22 are positioned relative to and fixed to each other so that the winding center line of the coil 27 coincides with the center of the gap δ between the upper magnet 24 and the lower magnet 25.

An upper surface 27*b* of the coil 27 may be abutted directly or through a spacer against and fixed by an adhesive agent to the driving-side attachment surface 5*a*, which is the lower surface of the driving-side frame 5.

As illustrated in FIG. 3, a supporting member 31 is fixed to the driving-side attachment surface 5*a*, which is the lower surface of the driving-side frame 5, and the armature 32 is attached to a lower surface 31*b* of the supporting member 31. The armature 32 and the supporting member 31 are both formed of a magnetic material, and are formed of, for example, a Ni—Fe alloy.

Figure 7A:
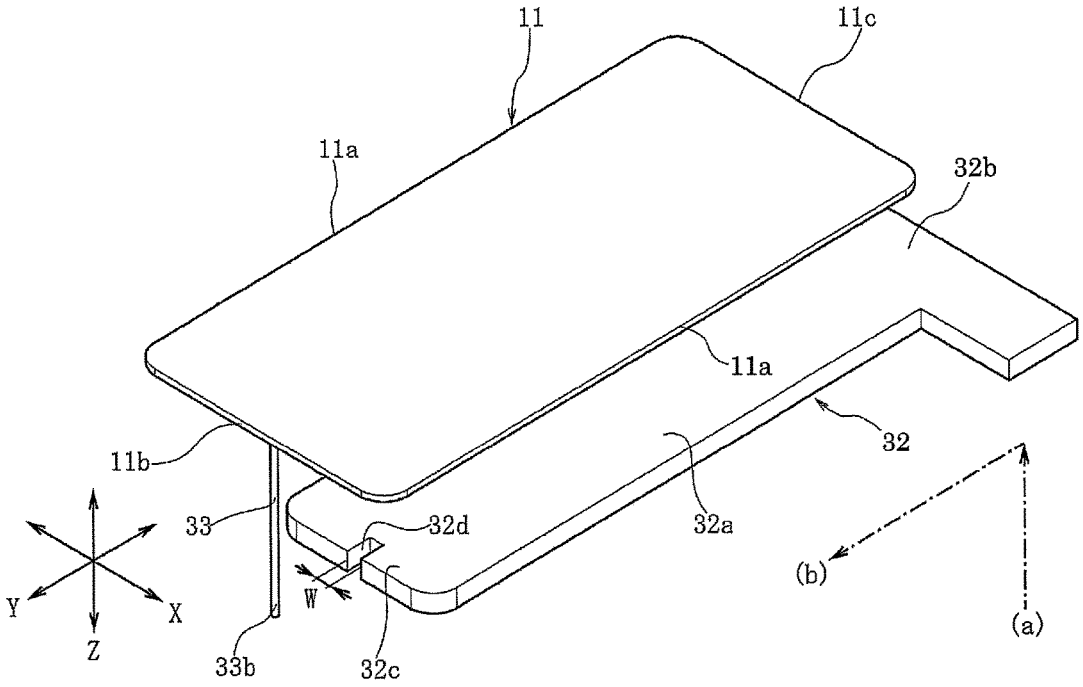
FIG. 7A and FIG. 7B are explanatory diagrams of assembling, illustrating incorporation of an armature of the first embodiment.
Figure 7B:
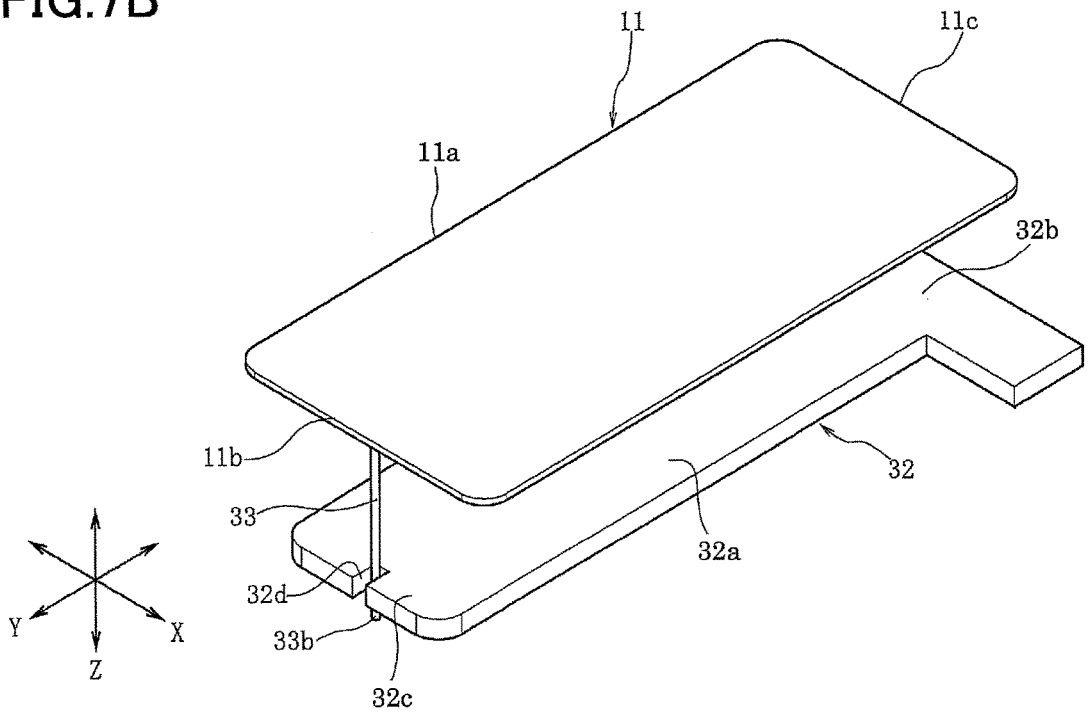

FIGS. 7A and 7B illustrate a shape of the armature 32. The armature 32 is a plate material having a uniform thickness dimension, and includes a proximal end section 32*b* having a large width dimension in the X direction, the vibrating section 32*a* smaller in width dimension than the proximal end section 32*b*, and a distal end section 32*c*, which is the tip of the vibrating section 32*a*. A recess 32*d* is formed in the widthwise center of the distal end section 32*c*. The recess 32*d* is open in the Y direction (leftward in FIG. 3), and the dimension of its opening width is indicated by W.

The armature 32 has the proximal end section 32*b* fixed to the lower surface 31*b* of the supporting member 31. The driving-side frame 5 and the supporting member 31 are fixed by laser welding or with an adhesive agent, and the supporting member 31 and the proximal end section 32*b* of the armature 32 are fixed by laser spot welding or soldering or with an adhesive agent. The vibrating section 32*a* is inserted into the space 27*c* in the winding center of the coil 27 and the gap δ between the upper magnet 24 and the lower magnet 25. The distal end section 32*c* of the armature 32 protrudes forward in the Y direction from within the gap δ.

As illustrated in FIG. 3, the free end 11*b* of the diaphragm 11 and the distal end section 32*c* of the armature 32 are connected by a transmitting body 33. The transmitting body 33 is a needle-shaped member formed of a metal or a synthetic resin, and has a fixing section 33*a* at the upper end fixed to the diaphragm 11. A lower end portion of the transmitting body 33 is a connecting end section 33*b*. The connecting end section 33*b* is inserted into the recess 32*d* of the armature 32, and the connecting end section 33*b* and the armature 32 are fixed with an adhesive agent.

According to this sound producing device 1, the driving-side frame 5 and the vibration-side frame 6 are separate members. Therefore, the driving-side frame 5 and the vibration-side frame 6 can be formed of different materials suitable for respective functions.

The driving-side frame 5 is preferably formed of a magnetic material. For example, the driving-side frame 5 is formed of SUS430 (18 chromium stainless steel). Forming the driving-side frame 5 of a magnetic material makes it possible for a magnetic flux to go around from the distal end section 32*c* of the armature 32 to a space to the driving-side frame 5 to the supporting member 31 to the proximal end section 32*b* of the armature 32 when a voice current is supplied to the coil 27 to have a magnetic field induced inside the armature 32, thus making it possible to increase magnetic flux density in the vibrating section 32*a* of the armature 32.

By selecting a material having higher affinity with an adhesive agent than the driving-side frame 5 for the vibration-side frame 6, it is possible to increase the bonding strength of the flexible sheet 12 and the vibration-side frame 6. That is, the material of the vibration-side frame 6 is selected so that the bonding strength of the vibration-side frame 6 and the flexible sheet 12 is higher than a bonding strength in the case of assuming that the flexible sheet 12 is bonded to the driving-side frame 5. For example, the vibration-side frame 6 is formed of SUS304 (18 chromium 8 nickel stainless steel: 18-8 stainless steel), which is non-magnetic stainless steel.

As illustrated in FIG. 3, the lower case 3 and the upper case 4 are joined and fixed across the driving-side frame 5 to have the internal space of the case 2 vertically separated by the diaphragm 11 and the flexible sheet 12. A space above the diaphragm 11 and the flexible sheet 12 and inside the upper case 4 is a sounding-side space, and the sounding-side space communicates with the external space through a sound emission opening 4*d* formed in the sidewall 4*b* of the upper case 4. An air inlet and outlet port 3*d* is formed in the sidewall 3*b* of the lower case 3, and a space below the diaphragm 11 and the flexible sheet 12 and inside the lower case 3 communicates with outside air through the air inlet and outlet port 3*d*.

Next, an operation of the sound producing device 1 is described.

When a voice current is supplied to the coil 27, a magnetic field is induced to the armature 32. The magnetic field induced to the armature 32 and a magnetic field generated in the gap δ between the upper magnet 24 and the lower magnet 25 generate vibrations in the Z direction in the vibrating section 32*a* of the armature 32. The vibrations are transmitted to the diaphragm 11 through the transmitting body 33 to vibrate the diaphragm 11. At this point, the diaphragm 11 supported by the flexible sheet 12 vibrates on the support-side end 11*c* serving as a support with the free end 11*b* vibrating in the Z direction.

The vibrations of the diaphragm 11 generate sound pressure in the sounding space inside the upper case 4, and this sound pressure is output to the outside through the sound emission opening 4*d*.

According to this sound producing device 1, the driving-side frame 5 and the vibration-side frame 6 are separately formed. The open area of the vibration-side opening 6*c* of the vibration-side frame 6 is larger than the open area of any opening of the driving-side frame 5. Therefore, the open area of the vibration-side opening 6*c* is increased to allow the diaphragm 11 installed inside to be as large as possible, thus making it possible to increase sound output.

Meanwhile, the driving-side frame 5 does not have to support the diaphragm 11, and the driving-side opening 5*c* may have an open area to let through the transmitting body 33. Therefore, the driving-side attachment surface 5*a*, which is the lower surface of the driving-side frame 5, can be formed to have a large area, thus making it possible to have the upper yoke 21 of the magnetic field generating unit 20 and the supporting member 31 supporting the armature 32 stably fixed thereto.

Furthermore, because the magnetic field generating unit 20 and the supporting member 31 supporting the armature 32 are attached with reference to the driving-side attachment surface 5*a*, which is a common plane surface, it is possible to reduce tolerance with respect to the relative positions of the gap δ between the upper magnet 24 and the lower magnet 25 and the vibrating section 32*a* of the armature 32 in the Z direction, thus making it easy to center the vibrating section 32*a* in the gap δ. In addition, even when adjustment work is required to center the vibrating section 32*a* in the gap δ, the adjustment work can be simplified than conventionally because the range of adjustment can be narrowed.

Moreover, because the driving-side frame 5 and the vibration-side frame 6 can be formed of different materials, it is possible to select, as the material of the vibration-side frame 6, a material that causes the vibration-side frame 6 to bond to the flexible sheet 12 with a higher strength than would the driving-side frame 5, for example, by forming the driving-side frame 5 of a magnetic material and forming the vibration-side frame 6 of a non-magnetic material.

Next, an example of the work of connecting the armature 32 and the transmitting body 33 in a process of manufacturing the sound producing device 1 is described.

In the process of manufacturing the sound producing device 1, the flexible sheet 12 to which the diaphragm 11 is joined is attached to the vibration-side frame 6, and the fixing section 33*a* of the transmitting body 33 at its upper end is fixed to the free end 11*b* of the diaphragm 11. Meanwhile, the magnetic field generating unit 20 to which the coil 27 is connected is fixed to the driving-side attachment surface 5*a* of the driving-side frame 5, and an upper surface 31*a* of the supporting member 31 is attached to the driving-side attachment surface 5*a* and the supporting member 31 is fixed to the driving-side attachment surface 5*a*.

Then, the driving-side frame 5 and the vibration-side frame 6 are placed one over the other to be positioned relative to and fixed to each other, and the armature 32 is thereafter incorporated.

In this work, the illustrated lower surface of the proximal end section 32*b* of the armature 32 is attracted and adhered to a suction part at the tip of an assembly arm provided in an automatic assembly machine.

The armature 32 is moved in the (a) direction indicated in FIG. 7A at a position where the distal end section 32*c* of the vibrating section 32*a* is off to the right of the coil 27 in the drawing, and the distal end section 32*c* is opposed with the space 27*c* of the coil 27. Thereafter, the assembly arm is moved along the Y direction parallel to the diaphragm 11 to move the armature 32 in the (b) direction indicated in FIG. 7A to insert the vibrating section 32*a* of the armature 32 into the space 27*c* of the coil 27 and the gap δ between the upper magnet 24 and the lower magnet 25.

The magnetic field generating unit 20 and the supporting member 31 are fixed with reference to the common driving-side attachment surface 5*a* of the driving-side frame 5. Therefore, by determining the dimensions of the magnetic field generating unit 20 and the supporting member 31 with high accuracy, it is possible, when incorporating the armature 32, to have the vibrating section 32*a* of the armature 32 coincide with the center of the gap δ between the upper magnet 24 and the lower magnet 25 with high accuracy by moving the armature 32 in the (a) direction and pressing the armature 32 against the lower surface 31*b* of the supporting member 31, and thereafter moving the armature 32 in the (b) direction while sliding the armature 32 on the lower surface 31*b* of the supporting member 31.

In this case, no adjustment work is necessary, and it is possible to complete an assembly by incorporating the armature 32 and joining the proximal end section 32*b* and the supporting member 31 with solder or an adhesive agent.

Even in the case of performing assembly work by adjusting the position of the armature 32, it is possible to simplify the adjustment work. For example, the assembly arm is moved in the Z direction to move the armature 32 in the (a) direction, and an adjustment is made to set the armature 32 at a position out of contact with the lower surface 31*b* of the supporting member 31 and at a predetermined distance in the Z direction from the driving-side attachment surface 5*a*. Next, the assembly arm is moved in the Y direction while maintaining its position in the Z direction to insert the vibrating section 32*a* into the space 27*c* of the coil 27 and the gap δ between the upper magnet 24 and the lower magnet 25. After completion of this adjustment work, solder or an adhesive agent is interposed between the proximal end section 32*b* of the armature 32 and the lower surface 31*b* of the supporting member 31 to complete fixation of the armature 32. Alternatively, the fixation is performed by laser welding.

By this attachment process including adjustment work as well, it is possible to have the vibrating section 32*a* of the armature 32 coincide with the center of the gap δ between the upper magnet 24 and the lower magnet 25 with high accuracy.

Thus, because the magnetic field generating unit 20 and the supporting member 31 are incorporated with reference to the driving-side attachment surface 5*a*, which is a common reference plane, it is possible to have the vibrating section 32*a* of the armature 32 coincide with the center of the gap δ between the upper magnet 24 and the lower magnet 25 with little adjustment work, or with simple work even if adjustment is performed.

As illustrated in FIG. 7A, the recess 32*d* is formed in the distal end section 32*c* of the armature 32, and the opening width dimension W of the recess 32*d* is greater than the width dimension (diameter dimension) of the connecting end section 33*b* in the lower end portion of the transmitting body 33. Therefore, as illustrated in FIG. 7A, when the armature 32 is slid in the (b) direction to be incorporated, it is possible to guide the connecting end section 33*b* of the transmitting body 33 into the recess 32*d* without application of an external force to the transmitting body 33.

After incorporating the armature 32 as described above and fixing the proximal end section 32*b* of the armature 32 to the supporting member 31, the connecting end section 33*b* of the transmitting body 33 is fixed to the distal end section 32*c* of the armature 32 with an adhesive agent or the like.

Next, other embodiments of the present invention are described.

Figure 4:
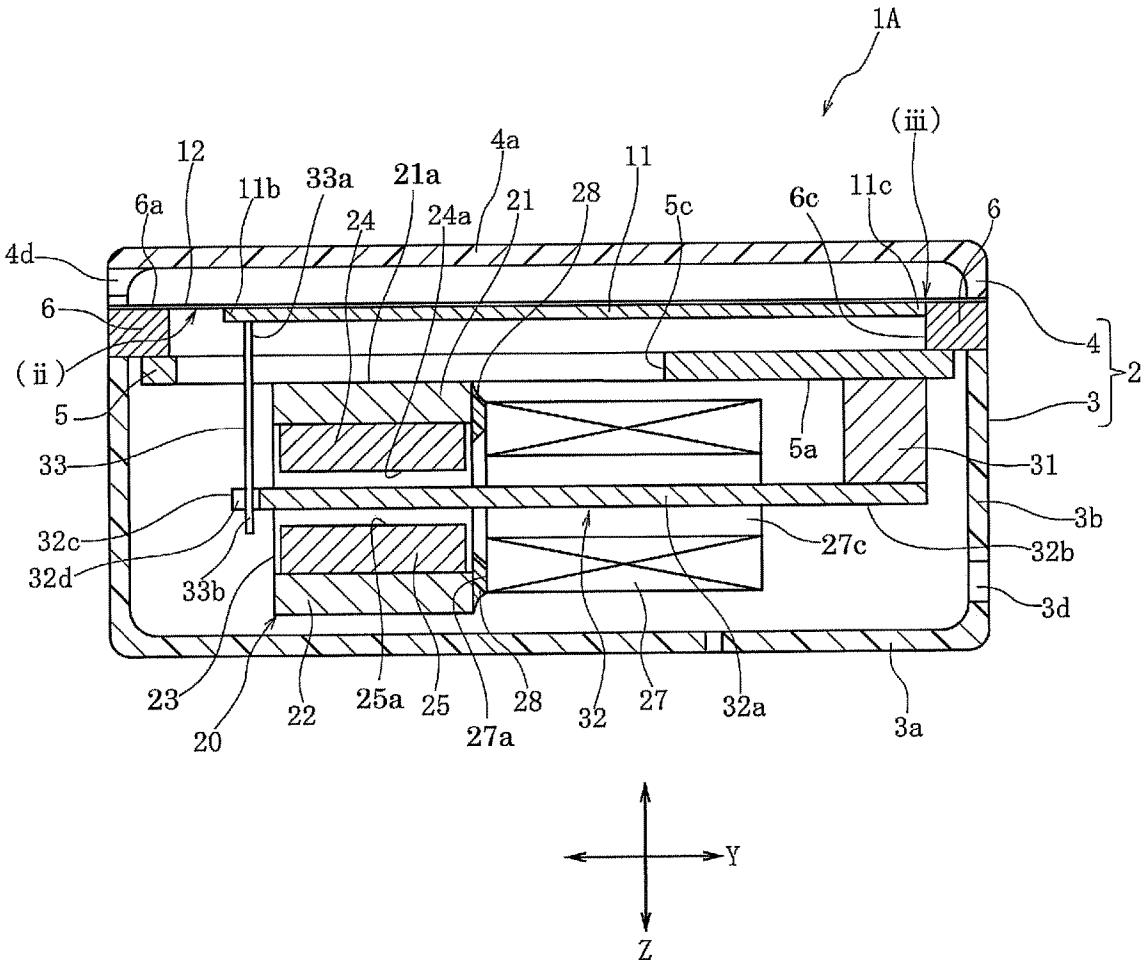
FIG. 4 is a sectional view illustrating a sound producing device of a second embodiment of the present invention.

FIG. 4 illustrates a sound producing device 1A of a second embodiment of the present invention.

According to the sound producing device 1A illustrated in FIG. 4, the vibration-side frame 6 is formed larger than the driving-side frame 5. The same as in the first embodiment, the diaphragm 11 and the flexible sheet 12 are supported on the vibration-side frame 6. The magnetic field generating unit 20 and the supporting, member 31 are fixed to the driving-side attachment surface 5*a* of the driving-side frame 5. The coil 27 is fixed to the magnetic field generating unit 20, and the proximal end section 32*b* of the armature 32 is fixed to the lower surface 31*b* of the supporting member 31.

According to the sound producing device 1A illustrated in FIG. 4, an outer peripheral portion of the vibration-side frame 6 is held and fixed between the lower case 3 and the upper case 4. The driving-side frame 5 is not held between the lower case 3 and the upper case 4, and is fixed to the lower surface of the vibration-side frame 6.

According to this embodiment, the vibration-side frame 6 is formed large enough to be held between the lower case 3 and the upper case 4. Therefore, the vibration-side opening 6*c* of the vibration-side frame 6 can have a large open area, and the diaphragm 11 placed within the vibration-side opening 6*c* as well can be formed to have a large area.

Figure 5:
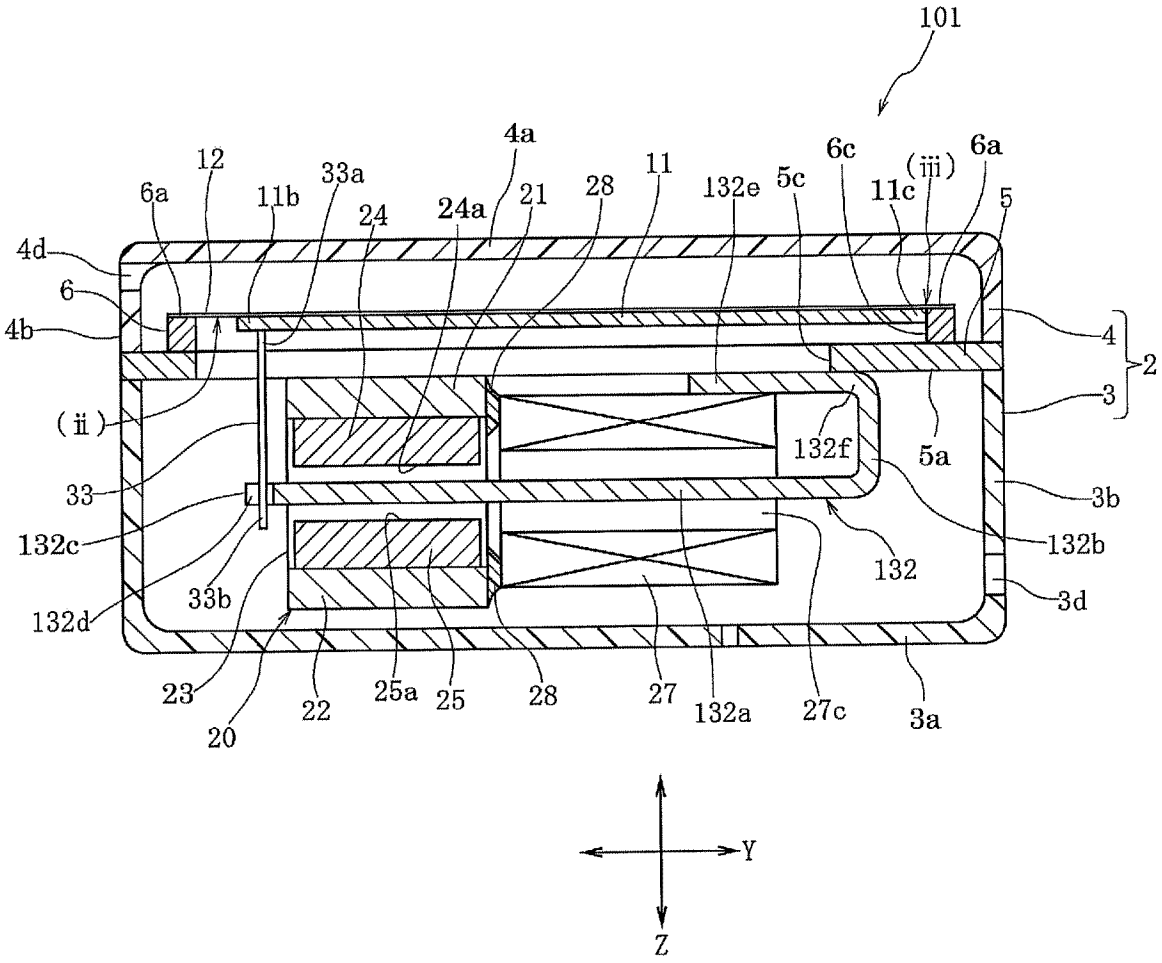
FIG. 5 is a sectional view illustrating a sound producing device of a third embodiment of the present invention.
Figure 6:
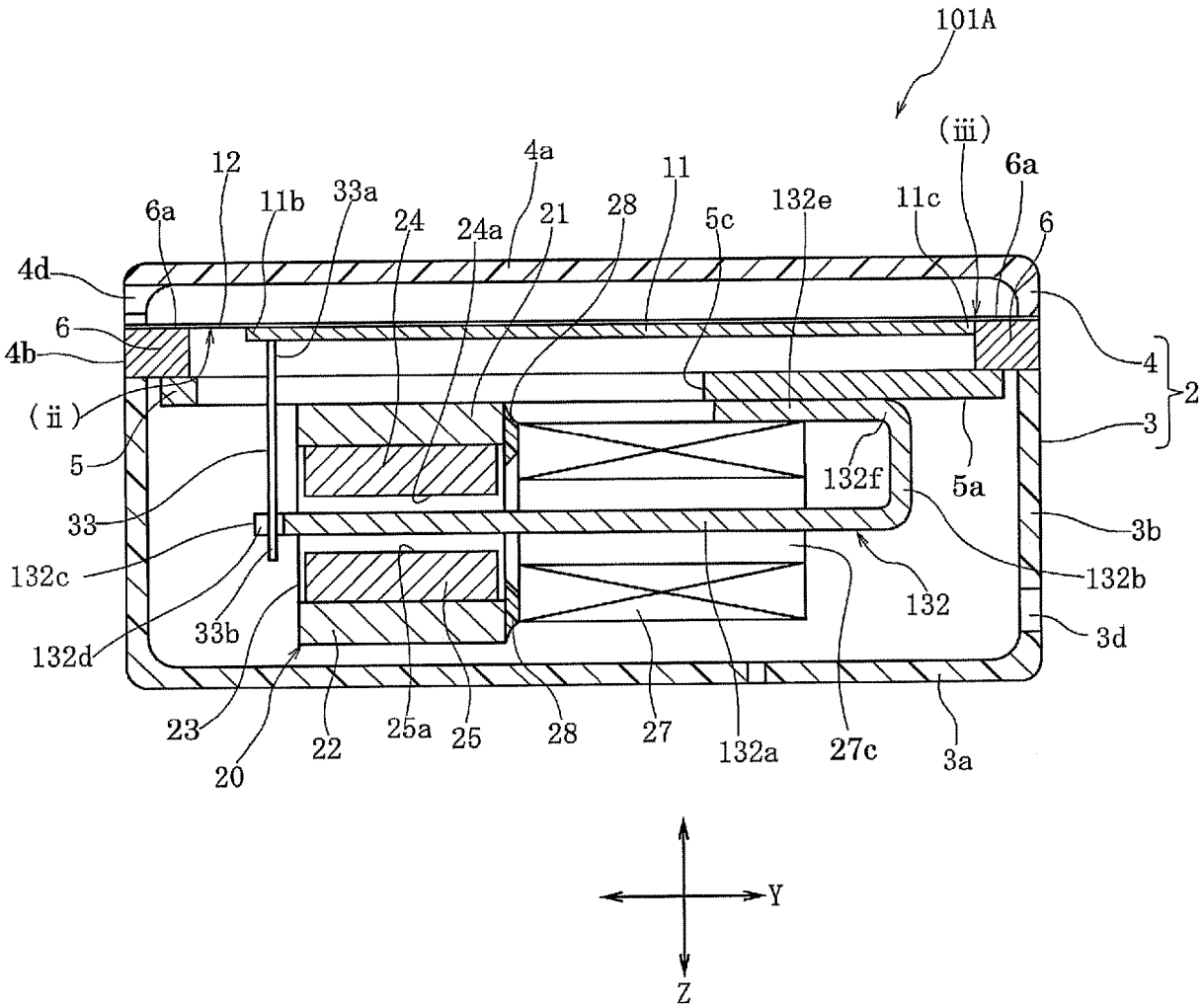
FIG. 6 is a sectional view illustrating a sound producing device of a fourth embodiment of the present invention.

FIG. 5 illustrates a sound producing device 101 of a third embodiment of the present invention. FIG. 6 illustrates a sound producing device 101A of a fourth embodiment of the present invention.

According to the sound producing device 101 illustrated in FIG. 5, the same as in the first embodiment illustrated in FIG. 3, the driving-side frame 5 is held between the lower case 3 and the upper case 4, and the vibration-side frame 6 is placed over and fixed to the driving-side frame 5. The sound producing device 101 illustrated in FIG. 5 and the first embodiment illustrated in FIG. 3 are different in armature structure but otherwise have the same configuration.

According to the sound producing device 101A illustrated in FIG. 6, the same as in the second embodiment illustrated in FIG. 4, the vibration-side frame 6 is held between the lower case 3 and the upper case 4, and the driving-side frame 5 is placed under and fixed to the vibration-side frame 6. The sound producing device 101A illustrated in FIG. 6 and the second embodiment illustrated in FIG. 4 are different in armature structure but otherwise have the same configuration.

According to an armature 132 illustrated in FIGS. 5 and 6, a U-shaped folded section 132*b* and a proximal end section 132*e* continuous therewith are formed together as one piece with a vibrating section 132*a* at its base. A recess 132*d* is formed in a distal end section 132*c* of the armature 132. Like the recess 32*d* illustrated in FIG. 7A, the recess 132*d* is formed with the opening width dimension W that is greater than the width dimension of the connecting end section 33*b* of the transmitting body 33.

According to the sound producing devices 101 and 101A illustrated in FIGS. 5 and 6, the armature 132 has the proximal end section 132*e* fixed to the driving-side attachment surface 5*a* of the driving-side frame 5. In the armature 132, a region from a boundary section 132*f* between the folded section 132*b* and the proximal end section 132*e* to the distal end section 132*c* is elastically deformable. Therefore, the vibratory displacement of the armature 132 can be large, and the amplitude of the armature 132 can be increased to increase sound output. Furthermore, even when the sound producing devices 101 and 101A have a smaller dimension in the Y direction to be reduced in size, it is possible to ensure a deformable region of the armature 132.

According to the armature 132, by determining the dimension in the Z direction between the vibrating section 132*a* and the proximal end section 132*e* with high accuracy, it is possible to center the vibrating section 132*a* in the gap δ between the upper magnet 24 and the lower magnet 25 with good accuracy by abutting and fixing the proximal end section 132*e* on the driving-side attachment surface 5*a* of the driving-side frame 5. Alternatively, it is possible to position and fix the armature 132 by holding the armature 132 with the suction part of an assembly arm and moving the armature 132 in the (a) direction as illustrated in FIG. 7A to adjust the distance between the driving-side attachment surface 5*a* and the vibrating section 132*a*, and thereafter moving the armature 132 in the (b) direction to incorporate the armature 132 and, in this state, filling the gap between the proximal end section 132*e* and the driving-side attachment surface 5*a* with solder or an adhesive agent.

FIGS. 8A, 8B, 9A and 9B illustrate variations of the transmitting body 33.

Figure 8A:
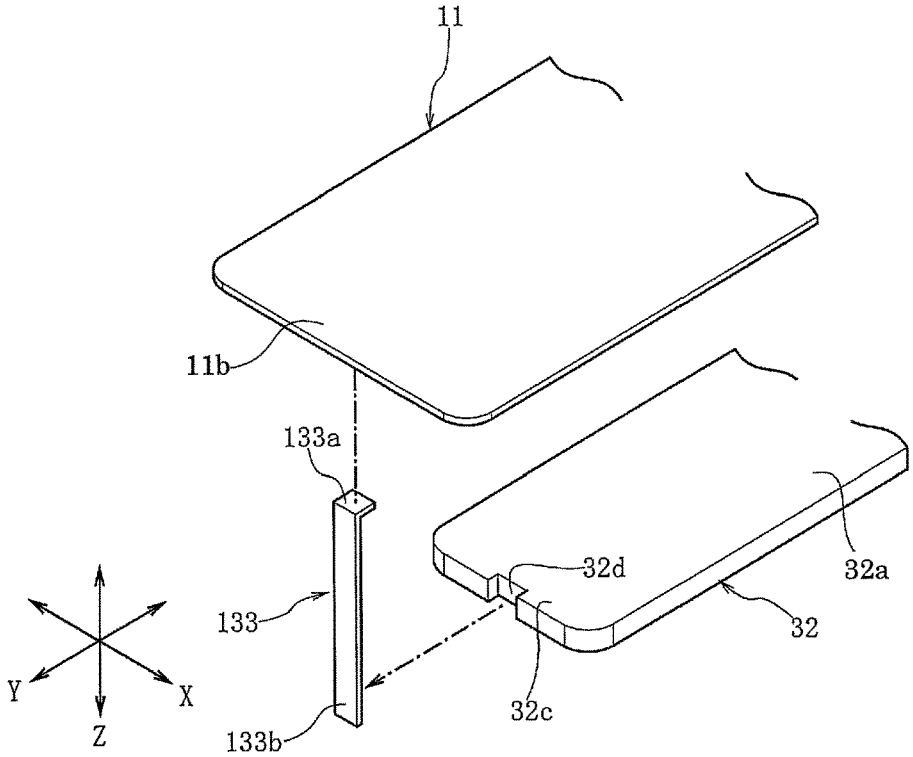
FIGS. 8A and 8B are explanatory diagrams of assembling, illustrating cases in which a transmitting member of another shape is used.

A transmitting body 133 illustrated in FIG. 8A has a thin plate shape, where a width dimension in the X direction is greater than a thickness dimension in the Y direction. An upper end portion is bent to form a fixing section 133*a* to be fixed to the diaphragm 11, and a lower end portion is a connecting end section 133*b* to be inserted into the recess 32*d* of the armature 32.

Figure 8B:
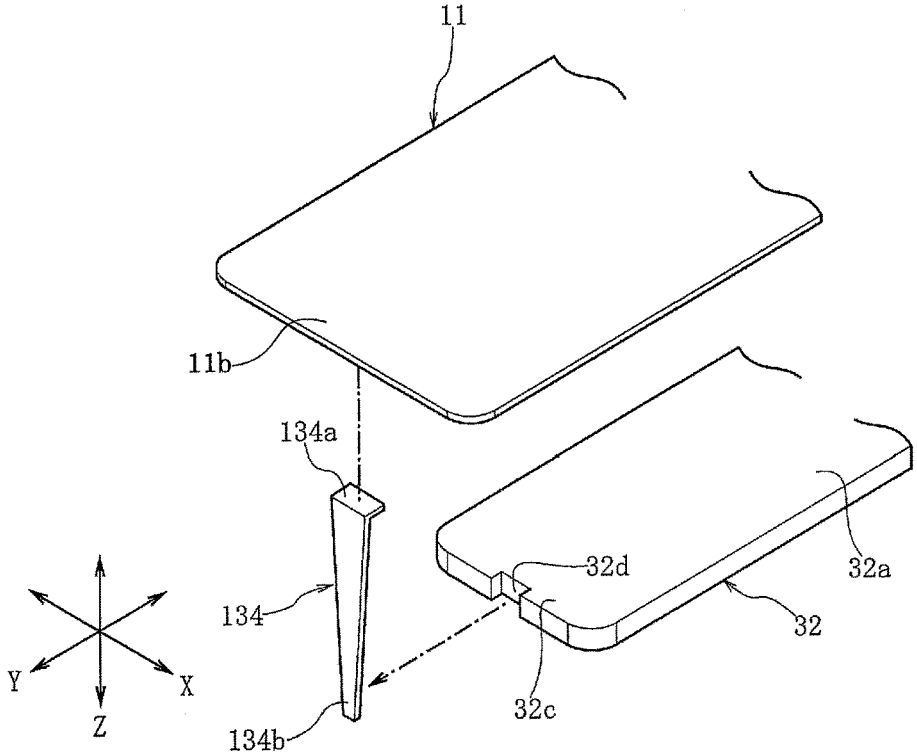

A transmitting body 134 illustrated in FIG. 8B has a thin plate shape, where a width dimension in the X direction is greater than a thickness dimension in the Y direction. An upper end portion is bent to form a fixing section 134*a* to be fixed to the diaphragm 11, and a lower end portion is a connecting end section 134*b* to be inserted into the recess 32*d* of the armature 32. The width dimension in the X direction of this transmitting body 134 gradually decreases from the fixing section 134*a* to the connecting end section 134*b*.

Figure 9A:
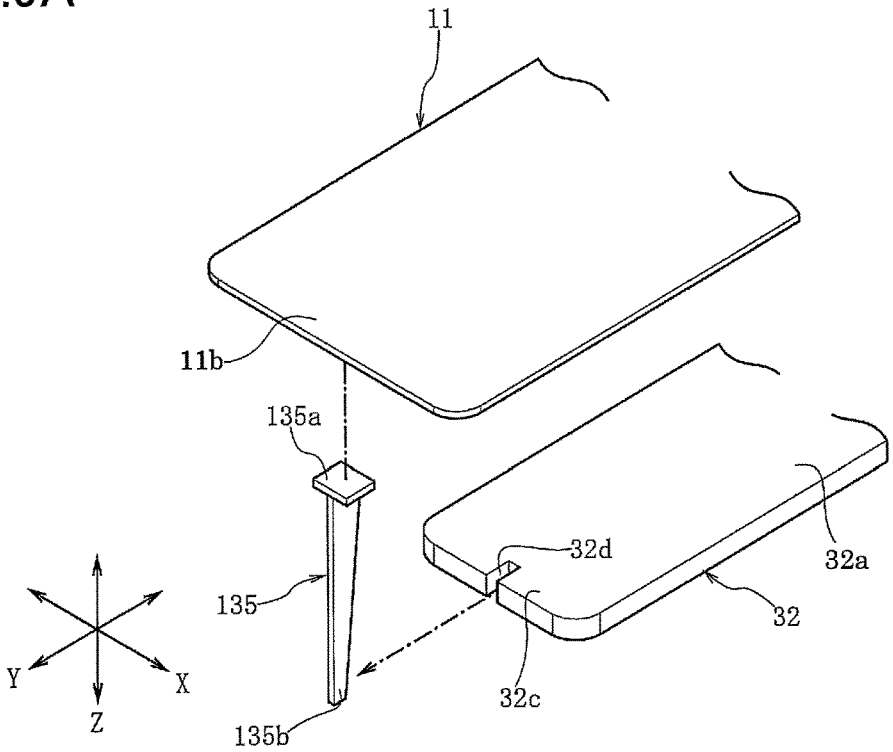
FIGS. 9A and 9B are explanatory diagrams of assembling, illustrating cases in which a transmitting member of yet another shape is used.

A transmitting body 135 illustrated in FIG. 9A has a thin plate shape, where a width dimension in the Y direction is greater than a thickness dimension in the X direction. An upper end portion is connected to a fixing section 135*a* to be fixed to the diaphragm 11, and a lower end portion is a connecting end section 135*b* to be inserted into the recess 32*d* of the armature 32.

Figure 9B:
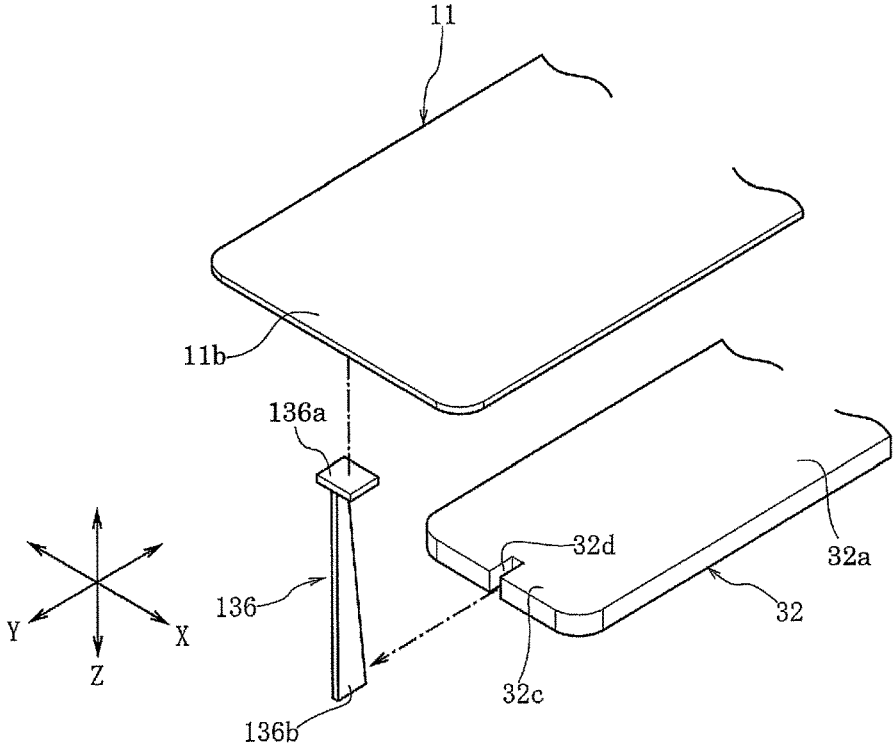

A transmitting body 136 illustrated in FIG. 9B has a thin plate shape, where a width dimension in the Y direction is greater than a thickness dimension in the X direction. An upper end portion is connected to a fixing section 136*a* to be fixed to the diaphragm 11, and a lower end portion is a connecting end section 136*b* to be inserted into the recess 32*d* of the armature 32. The width dimension in the Y direction of this transmitting body 136 gradually increases from the fixing section 136*a* to the connecting end section 136*b*.

According to an embodiment of the present invention, a sound producing device includes a diaphragm, an armature extending parallel to the diaphragm, a coil having a wire wound around the armature in multiple turns, multiple magnets facing the armature, a yoke supporting the multiple magnets, a transmitting body configured to transmit a vibration of the armature to the diaphragm, a driving-side frame on which the armature, the coil, and the yoke supporting the multiple magnets are mounted, and a vibration-side frame including an opening in which the diaphragm is vibratably supported. The driving-side frame and the vibration-side frame are placed one over the other.

According to the above-described sound producing device, by providing a large opening in the vibration-side frame, a diaphragm having as large an area as possible can be placed in the opening, while the armature, the coil, and the magnets can be stably positioned and fixed on the driving-side frame.

According to the above-described sound producing device, a proximal end section of the armature and the yoke are preferably attached with reference to an attachment surface of the driving-side frame.

In this specification, "being attached with reference to an attachment surface of the driving-side frame" means not only that the proximal end section of the armature and the yoke supporting the magnets are directly attached to the attachment surface, but also, for example, that the proximal end section of the armature is fixed to the attachment surface through a supporting member and the yoke is fixed to the attachment surface through another member. Because there is no need to form a large opening in the driving-side frame, it is possible to ensure that the attachment surface is large. Therefore, the proximal end section of the armature and the yoke can be fixed with high attachment accuracy with reference to the attachment surface.

According to the above-described sound producing device, the diaphragm may be placed in the opening formed in the vibration-side frame, a gap between an edge of the opening and an edge of the diaphragm may be closed by a flexible sheet, and the opening formed in the vibration-side frame may have a larger open area than any opening formed in the driving-side frame.

According to the above-described sound producing device of the present invention, the driving-side frame may be formed of a magnetic material, and the vibration-side frame may be formed of a non-magnetic material.

In this case, the driving-side frame and the armature can form a magnetic path.

According to the above-described sound producing device, preferably, the driving-side frame and the vibration-side frame are formed of different materials, and the bonding strength of the flexible sheet and the vibration-side frame is higher than the bonding strength of the flexible sheet and the driving-side frame in the case of assuming that the flexible sheet is bonded to the driving-side frame.

As described above, by forming the driving-side frame and the vibration-side frame of different materials, it is possible to select both of a material suitable for supporting the diaphragm and a material suitable for supporting the armature and the magnets.

According to the above-described sound producing device of the present invention, preferably, a recess is formed in a distal end section of the armature to be open in a direction away from a proximal end section of the armature, the recess has a greater width than a connecting end section of the transmitting body, the connecting end section is positioned in the recess and fixed to the armature.

For example, the cross-sectional area of the transmitting body is smaller in the connecting end section than in a section fixed to the diaphragm. Alternatively, the cross-sectional area of the transmitting body is greater in the connecting end section than in a section fixed to the diaphragm.

Forming a recess in the distal end section of the armature as described above makes it possible to easily connect the armature and the transmitting body without application of an excessive external force to the transmitting body by incorporating the armature by inserting the armature in a direction parallel to the diaphragm with a fixing section of the transmitting body being fixed to the diaphragm.

According to the above-described sound producing device, the driving-side frame may be fixed to a case, and the vibration-side frame may be fixed to the driving-side frame.

Alternatively, the vibration-side frame may be fixed to a case, and the driving-side frame may be fixed to the vibration-side frame.

According to an aspect of the present invention, a sound producing device in which an armature, magnets, and a coil can be stably fixed with a sufficiently large space for installing a diaphragm being secured is provided.

According to an aspect of the present invention, a vibration-side frame has a frame shape having a large opening so that a diaphragm having a large area can be movably supported thereon. A large opening is not provided in a driving-side frame to make it possible to form a large attachment surface that serves as a reference for supporting an armature and a yoke. Thus, it is possible to position and fix an armature, a yoke that supports magnets, and a coil in a stable condition.

The above-described structure makes it easier to determine the positions of an armature, magnets, and a coil relative to one another, and adjustment work can be simpler or less than conventionally.

Furthermore, the vibration-side frame can be formed of a material suitable for supporting a diaphragm, and the driving-side frame can be formed of a material suitable for magnetically driving an armature.

All examples and conditional language provided herein are intended for pedagogical purposes of aiding the reader in understanding the invention and the concepts contributed by the inventors to further the art, and are not to be construed as limitations to such specifically recited examples and conditions, nor does the organization of such examples in the specification relate to a showing of the superiority or inferiority of the invention. Although one or more embodiments of the present invention have been described in detail, it should be understood that the various changes, substitutions, and alterations could be made hereto without departing from the spirit and scope of the invention.

What is claimed is:

1. A sound producing device comprising:

a diaphragm;

an armature extending parallel to the diaphragm;

a coil having a wire wound around the armature in multiple turns;

a plurality of magnets facing the armature;

a yoke supporting the plurality of magnets;

a transmitting body configured to transmit a vibration of the armature to the diaphragm;

a driving-side frame including a first plane surface on which the armature, the coil, and the yoke supporting the plurality of magnets are attached;

a vibration-side frame including an opening in which the diaphragm is vibratably supported, the vibration-side frame having a surface that is joined surface to surface to a second plane surface of the driving-side frame, the second plane surface being on an opposite side of the driving-side frame from the first plane surface such that the driving-side frame and the vibration-side frame are placed one over another; and a first case and a second case that are fixed to the first plane surface and the second plane surface, respectively, of the driving-side frame such that the driving-side frame is held between the first case and the second case.

2. The sound producing device as claimed in claim 1, wherein a proximal end section of the armature and the yoke are attached with reference to the first plane surface of the driving-side frame.

3. The sound producing device as claimed in claim 1, wherein the diaphragm is placed in the opening formed in the vibration-side frame, a gap between an edge of the opening and an edge of the diaphragm is closed by a flexible sheet, and the opening formed in the vibration-side frame has a larger open area than any opening formed in the driving-side frame.

4. The sound producing device as claimed in claim 3, wherein the driving-side frame and the vibration-side frame are formed of different materials, and a bonding strength of the flexible sheet and the vibration-side frame is higher than a bonding strength of the flexible sheet and the driving-side frame when the flexible sheet is bonded to the driving-side frame.

5. The sound producing device as claimed in claim 1, wherein the driving-side frame is formed of a magnetic material, and the vibration-side frame is formed of a non-magnetic material.

6. The sound producing device as claimed in claim 5, wherein the driving-side frame and the armature form a magnetic path.

7. The sound producing device as claimed in claim 1, wherein a recess is formed in a distal end section of the armature to be open in a direction away from a proximal end section thereof, the recess having a greater width than a connecting end section of the transmitting body, the connecting end section being positioned in the recess and fixed to the armature.

8. The sound producing device as claimed in claim 7, wherein a cross-sectional area of the transmitting body is smaller in the connecting end section than in a section fixed to the diaphragm.

9. The sound producing device as claimed in claim 7, wherein a cross-sectional area of the transmitting body is greater in the connecting end section than in a section fixed to the diaphragm.

* * * * *